US010439324B2

(12) United States Patent
Nishii et al.

(10) Patent No.: US 10,439,324 B2
(45) Date of Patent: Oct. 8, 2019

(54) LEVER-TYPE CONNECTOR

(71) Applicant: Sumitomo Wiring Systems, Ltd., Yokkaichi, Mie (JP)

(72) Inventors: Hiroko Nishii, Mie (JP); Yoshihiro Mizutani, Mie (JP); Yuichi Goto, Mie (JP); Yusuke Hamada, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/030,897

(22) Filed: Jul. 10, 2018

(65) Prior Publication Data

US 2019/0027863 A1 Jan. 24, 2019

(30) Foreign Application Priority Data

Jul. 18, 2017 (JP) ..... 2017-138754

(51) Int. Cl.
*H01R 13/629* (2006.01)
*H01R 13/506* (2006.01)
*H01R 13/631* (2006.01)

(52) U.S. Cl.
CPC ..... *H01R 13/62938* (2013.01); *H01R 13/506* (2013.01); *H01R 13/631* (2013.01)

(58) Field of Classification Search
CPC ..... H01R 13/62933–13/62961; H01R 13/506; H01R 13/631
USPC ..... 439/157, 372
See application file for complete search history.

(56) References Cited

U.S. PATENT DOCUMENTS 5,017,149 A * 5/1991 Hatanaka ..... H01R 13/62994 439/157
5,562,465 A * 10/1996 Taguchi ..... H01R 13/62933 439/157
7,066,747 B2 * 6/2006 Nagano ..... H01R 13/641 439/157
9,812,813 B1 * 11/2017 Sakamoto ..... H01R 13/502
2012/0129381 A1 * 5/2012 Makino ..... H01R 13/62938 439/372
2014/0017932 A1 * 1/2014 Ohyama ..... H01R 12/79 439/374
2015/0016876 A1 * 1/2015 Kamiya ..... H01R 13/62938 403/322.4

(Continued)

FOREIGN PATENT DOCUMENTS

JP 10-321289 12/1998

*Primary Examiner* — Gary F Paumen
(74) *Attorney, Agent, or Firm* — Gerald E. Hespos; Michael J. Porco; Matthew T. Hespos

(57) ABSTRACT

A lever-type connector (1) includes a housing (10) and a lever (40) rotatably mounted on the housing (10) and includes two arm plates (41) coupled by an operating portion (42). The connector (1) is connectable to a mating connector by rotating the lever (40). Two support shafts (21) project from outer side surfaces (12) of the housing (10). The arm plates (41) include shaft holes (43) and start opening deformation while riding on the support shafts (21). The arm plates (41) return when the support shafts (21) fit into the shaft holes (43). Each arm plate (41) includes an inclined receiving surface (45) inclined toward the operating portion (42). An inclined surface (21A) is provided on a projecting end of the support shaft (21) and is configured to come into surface contact with the inclined receiving surface (45) at a ride initial position of the arm plates (41).

4 Claims, 19 Drawing Sheets

(56) References Cited

U.S. PATENT DOCUMENTS

| | | | | |
|---|---|---|---|---|
| 2015/0111414 | A1* | 4/2015 | Kamiya | H01R 13/62933<br>439/372 |
| 2016/0365672 | A1* | 12/2016 | Yamada | H01R 13/62933 |
| 2017/0110830 | A1* | 4/2017 | Yamada | H01R 13/62938 |
| 2018/0013233 | A1* | 1/2018 | Takamura | H01R 13/62933 |
| 2018/0248312 | A1* | 8/2018 | Shinmi | H01R 13/62955 |

* cited by examiner

LEVER-TYPE CONNECTOR

BACKGROUND

Field of the Invention

This specification relates to a lever-type connector.

Description of the Related Art

Japanese Unexamined Patent Publication No. H10-321289 discloses a connector with a lever for connection to a mating connector. This lever-type connector includes a connector body and a lever. Support shafts project on both outer side surfaces of the connector body. The lever includes two arms disposed on both outer side surfaces of the connector body and an operating portion coupling the arms. Each arm includes a bearing hole, a guide in the form of a groove from an outer edge of the arm to the bearing hole, and an inclined surface provided between side walls of the guide. In assembling the lever with the connector body, tips of the support shafts of the connector body are guided to the bearing holes by the side walls of the guides while sliding in contact with the inclined surfaces of the arms.

However, both arms are open on one-side with the operating portion as a base. Thus, the tips of the support shafts and the inclined surfaces of the guides are in point contact. Accordingly, the tips of the support shafts are in unstable point contact with the inclined surfaces of the guides while the support shafts are pushed into the bearing holes, and can freely move between the side walls of the guides. In addition, immediately before the support shafts are fit into the bearing holes, i.e. when the opening of the arm portions reaches a peak and resistance forces to the support shafts are maximized, the arms are twisted to a maximum degree. Thus, in pushing the support shafts into the bearing holes against the resilience of the arms, the support shafts may be displaced in directions away from fitting directions to move over the side walls of the guides, and the lever may not be mounted properly.

SUMMARY

A lever-type connector disclosed by this specification has a housing and a lever rotatably mounted on the housing. The lever has two arm plates coupled by an operating portion. The lever-type connector is connectable to a mating connector by rotating the lever. Two support shafts project on outer side surfaces of the housing. The arm plates include shaft holes and start opening deformation while riding on the support shafts and return when the arm plates move over the support shafts so that the support shafts fit into the shaft holes. Each arm plate includes an inclined receiving surface inclined toward the operating portion, and an inclined surface configured to come into surface contact with the inclined receiving surface at a ride initial position of the arm plates is provided on a projecting end of the support shaft.

In pushing and mounting the lever onto the housing, the arm plates start opening deformation while riding on the support shafts and return when the support shafts fit into the shaft holes. A pushing force for the lever is largest when the opening deformation of the arm plates is started. The inclined receiving surface of each arm plate is inclined toward the operating portion. Thus, the arm plate is not opened only on one side and the inclined surface rides on the inclined receiving surface when the arm plates are opened and deformed with the operating portion as a base. Therefore, a riding operation is started with the lever held in a stable posture with respect to the housing, and the lever is mounted at once while maintaining a proper mounting posture with respect to the housing.

The arm plate may have a guided portion. The guided portion, the operating portion and the shaft hole may be provided linearly side by side. A position where the lever is assembled with the housing is an assemble initial position. A guide portion may be provided between the assemble initial position and the ride initial position on the outer side surface of the housing and may be configured to guide the guided portion. According to this configuration, the inclined surface and the inclined receiving surface can be brought into surface contact with each other merely by linearly displacing the guided portion along the guide portion of the housing. Further, when the inclined receiving surface rides on the inclined surface, the inclined receiving surface can ride directly on the support shaft in a guiding direction of the guide portion.

The guided portion may include a ridge projecting on an inner side surface of the arm plate. Additionally, the guide portion may include two guide rails projecting from the outer side surface of the housing, and the ridge may enter between the guide rails. According to this configuration, the ridge enters between the guide rails and is guided in a moving direction by the guide rails. Thus, the lever can be guided reliably from the assemble initial position toward the ride initial position.

The lever may be rotatable from an assemble end position where the arm plates return by the support shafts being fit into the shaft holes when moving over the support shafts to a connection initial position where the mating connector is connected. Rotation of the lever from the connection initial position to the assemble end position connects the mating connector to the housing. The arm plate may have a lock with a deflection piece in the form of a tongue that is deflectable and deformable in a direction perpendicular to a rotating direction of the lever. A lock claw may be provided on a tip of the deflection piece and may project in an overhanging manner in the direction perpendicular to the rotating direction of the lever. A lock receiving portion may be provided on the outer side surface of the housing and may project in an overhanging manner on a rotation locus of the lock claw for locking with the lock claw. The deflection piece may be inward of the arm plate to restrict deformation when the lock claw is locking the lock receiving portion to restrict rotation between the connection initial position and the assemble end position. According to this configuration, the lock claw locks the lock receiving portion to restrict rotation of the lever, and the deflection piece is inward of the arm plate to have deflection restricted between the connection initial position to the assemble end position. In this way, the lock will not displace outward of the arm plate to release locking with the lock receiving portion during an attempt to rotate the lever when the lock is locking the lock receiving portion.

According to this specification, it is possible to provide a lever-type connector enabling a lever to be assembled without difficulty.

DETAILED DESCRIPTION

Figure 1:
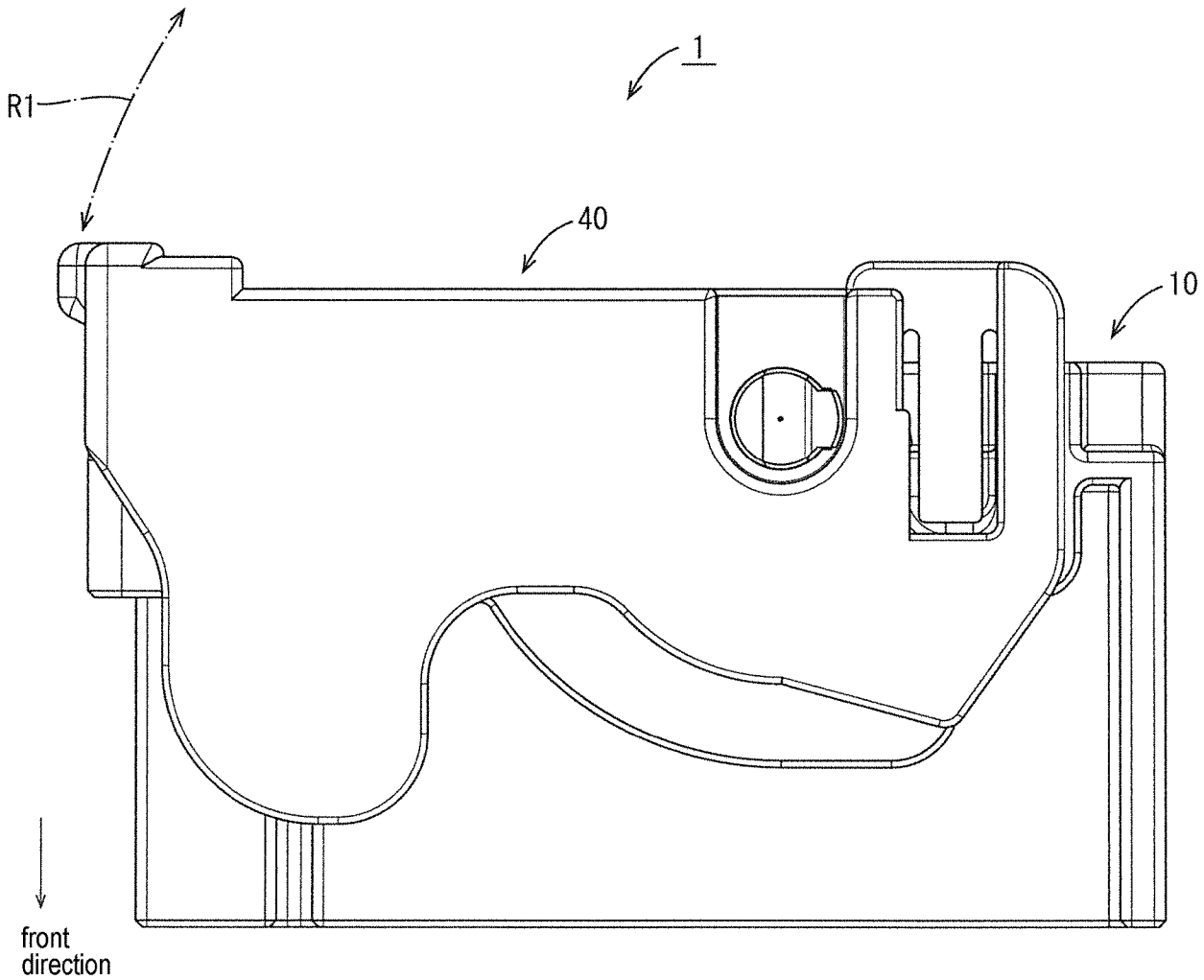
FIG. 1 is a view showing a lever-type connector according to an embodiment.

One embodiment of the invention is described with reference to FIGS. 1 to 18. A lever-type connector 1 in this embodiment includes a housing 10 and a lever 40, as shown in FIG. 1. The lever 40 is mounted rotatably on the housing 10, and the housing 10 is connectable to and separable from an unillustrated mating connector by rotating the lever 40 in rotating directions R1. In the following description, a connection side of the housing 10 to the mating connector is referred to as a front. Further, for a plurality of identical members, one member may be denoted by a reference sign and the other members may not be denoted by the reference sign.

Figure 8:
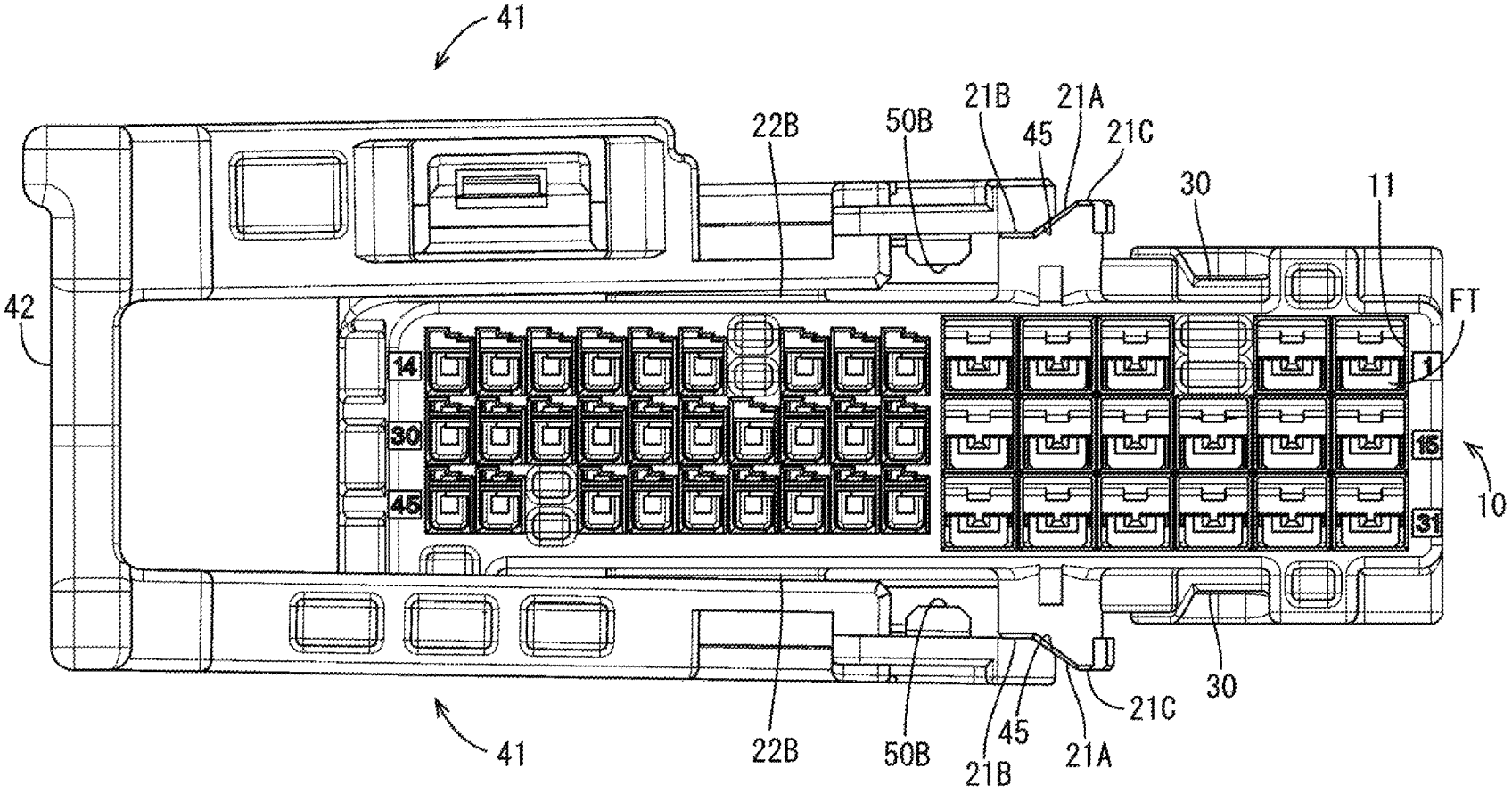
FIG. 8 is a view showing a state where the lever is at a ride initial position.
Figure 12:
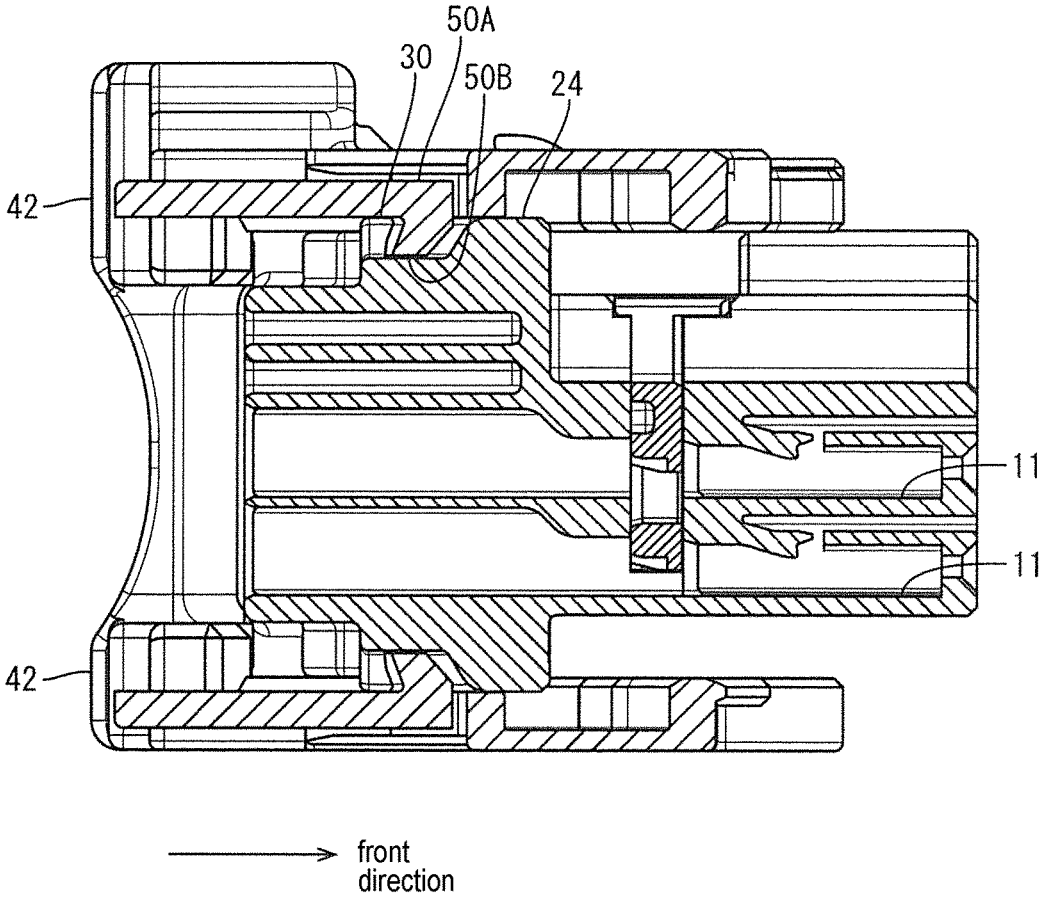
FIG. 12 is a section along B-B of FIG. 11.

The housing 10 is made of synthetic resin and is substantially in the form of a somewhat flat rectangular parallelepiped. As shown in FIG. 12, cavities 11 penetrate the housing 10 in a front-rear direction. As shown in FIG. 8, female terminals FT are accommodated in the cavities 11 and connect to unillustrated male terminals in the mating connector as the housing 10 and the mating connector are connected. Unillustrated wires connected to the female terminals FT extend through openings on back surface sides of the cavities 11.

Figure 2:
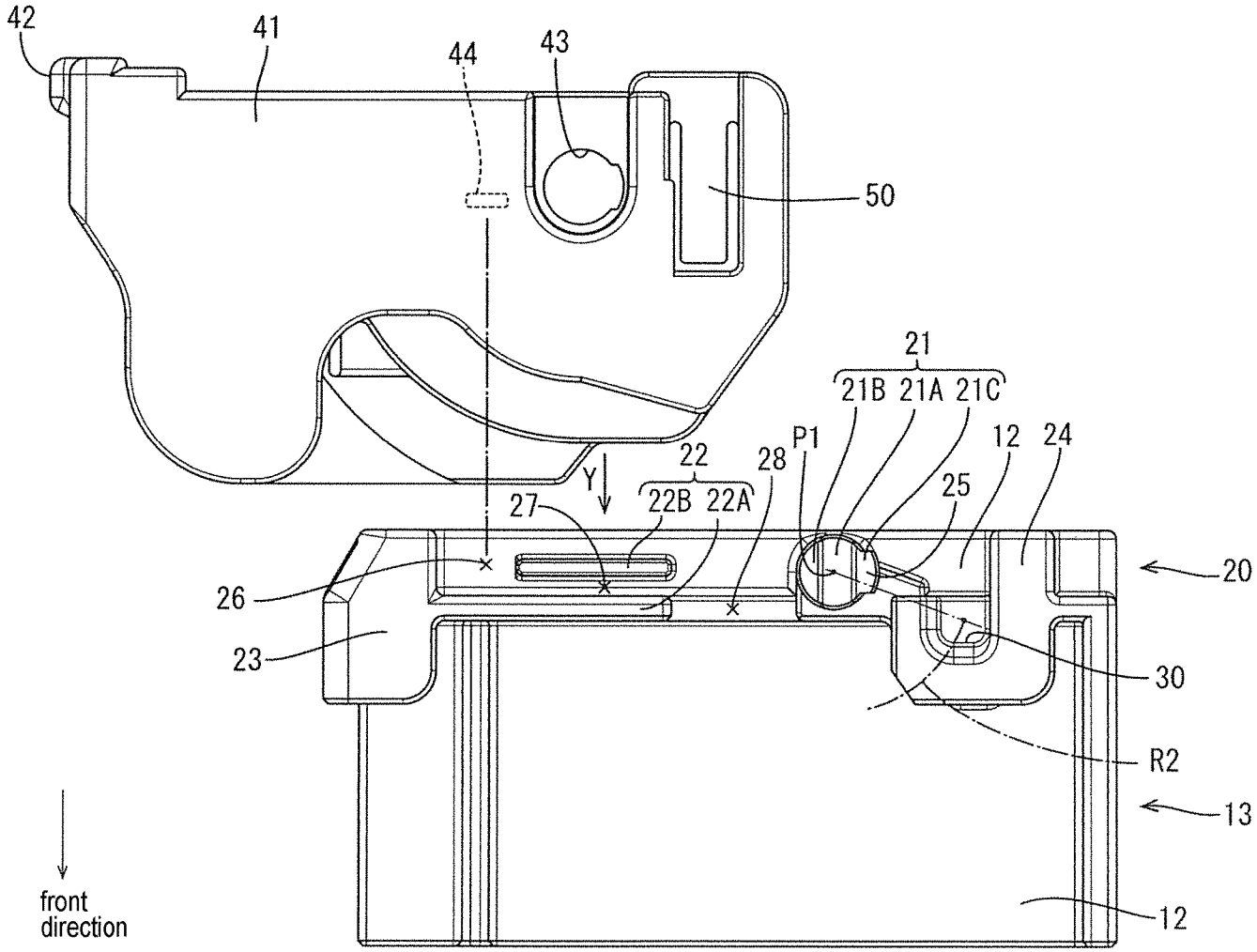
FIG. 2 is a view showing a state where a lever is disposed at a position before assembling with respect to a connector.

As shown in FIG. 2, the front of the housing 10 defines a connector fitting portion 13 into which the mating connector is fit, and a rear defines a lever mounting portion 20 on which the lever 40 is mounted.

The lever mounting portion 20 has two parallel outer side surfaces 12, 12. Each outer side surface 12 has a support shaft 21 for rotatably supporting the lever 40, a guide 22 for guiding the lever 40 to the support shaft 21, a closing protrusion 23 and a planar protrusion 24 for supporting the lever 40 from inside. These members on the opposite outer side surfaces 12 are positions corresponding to one another in a front-rear direction and a lateral direction of the housing 10.

The support shaft 21 has a cylindrical shape and projects from the outer side surface 12. A central part of a projecting end of the support shaft 21 in the lateral direction is formed into an inclined surface 21A inclined leftward in FIG. 2. First and second flat surfaces 21B and 21C are to the left and right of the inclined surface 21A and are parallel to the outer side surface 12. A holding protrusion 25 protrudes on a right end part of the support shaft 21 for preventing the lever 40 from coming off the support shaft 21. A projecting end of the holding protrusion 25 is flat and coplanar with the second flat surface 21C.

The guide 22 is composed of parallel front and rear rails 22A, 22B between a left end of the lever mounting portion 20 and the support shaft 21. The rear rail 22B is shorter than a front rail 22A. Right ends of the front and rear rails 22A, 22B are at the same position in the lateral direction. A space between the front and rear rails 22A, 22B serves as a lateral guiding path 27 for displacing a ridge 44 of an arm plate 41 to be described later in the lateral direction. A clearance is provided between the guide portion 22 and the support shaft 21 and serves as an escaping portion 28 for allowing the ridge 44 of the arm plate 41 to escape rearwardly.

The closing protrusion 23 is provided side by side with the guide 22 on the left end of the lever mounting portion 20. A space between a right end of the closing protrusion 23 and the rear rail 22B serves as an introducing portion 26 into which the ridge 44 of the arm plate 41 is inserted. The right end of the closing protrusion 23 is linear and connected to the front rail 22A substantially in a center. Specifically, the introducing portion 26 has left and front sides closed by the closing protrusion 23 and the front rail 22A.

The planar protrusion 24 is disposed to the right of the support shaft 21. The planar protrusion 24 is formed into a J shape by protruding from a rear end of the lever mounting portion 20 to the connector fitting portion 13 and being curved toward the vicinity of the projecting end of the support shaft 21. A flat surface is defined at a projecting end of the planar protrusion 24. A curved inner surface of the planar protrusion 24 is sloped to be wider toward a bottom surface (region of the outer side surface 12 enclosed by the curved inner surface) and serves as a side wall of a locking accommodation recess 30.

Figure 15:
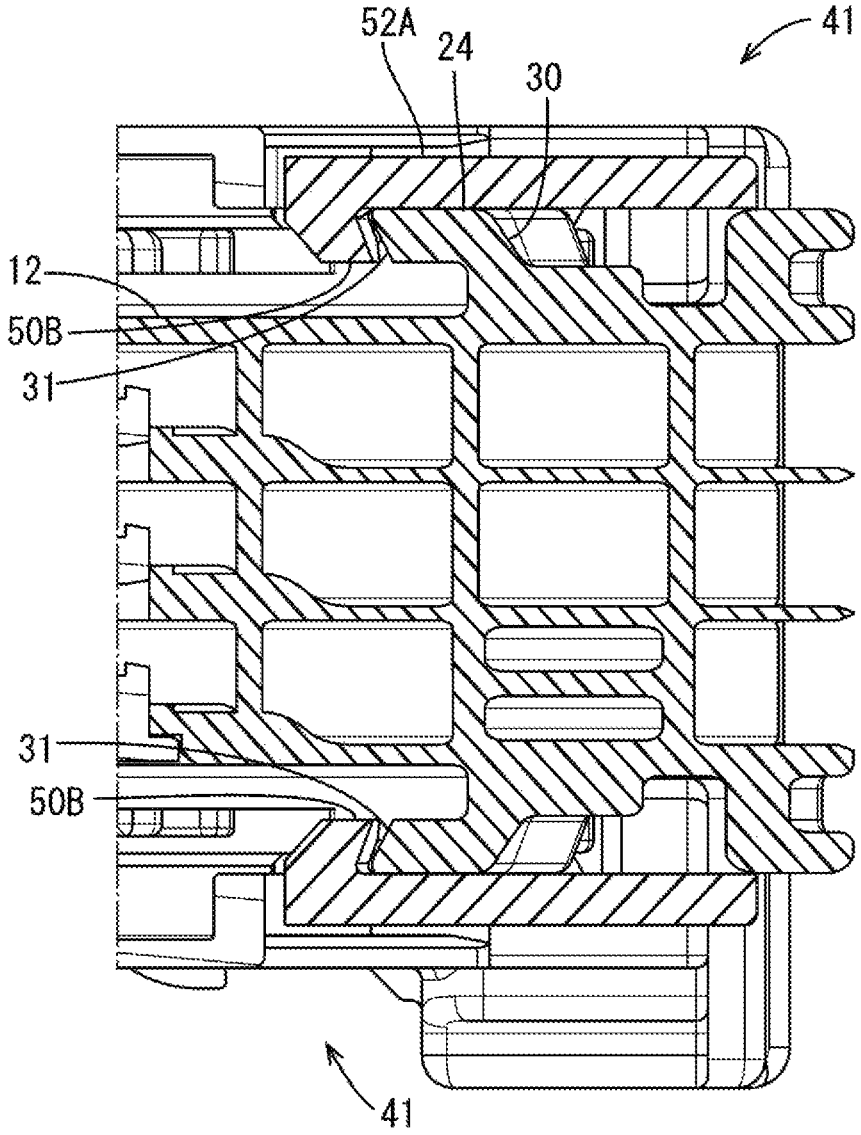
FIG. 15 is a section along C-C of FIG. 13.

A lock receiving portion 31 is formed on an outer side surface of the planar protrusion 24 and is to be locked by a lock claw 50B of the lever 40 to be described later. As shown in FIG. 15, the lock receiving portion 31 is a flat surface overhanging with respect to the outer side surface 12 and is perpendicular to a rotation locus R2 passing through a center of the bottom surface of the locking accommodation recess 30 with an axis center P1 of the support shaft 21 as a center.

Figure 3:
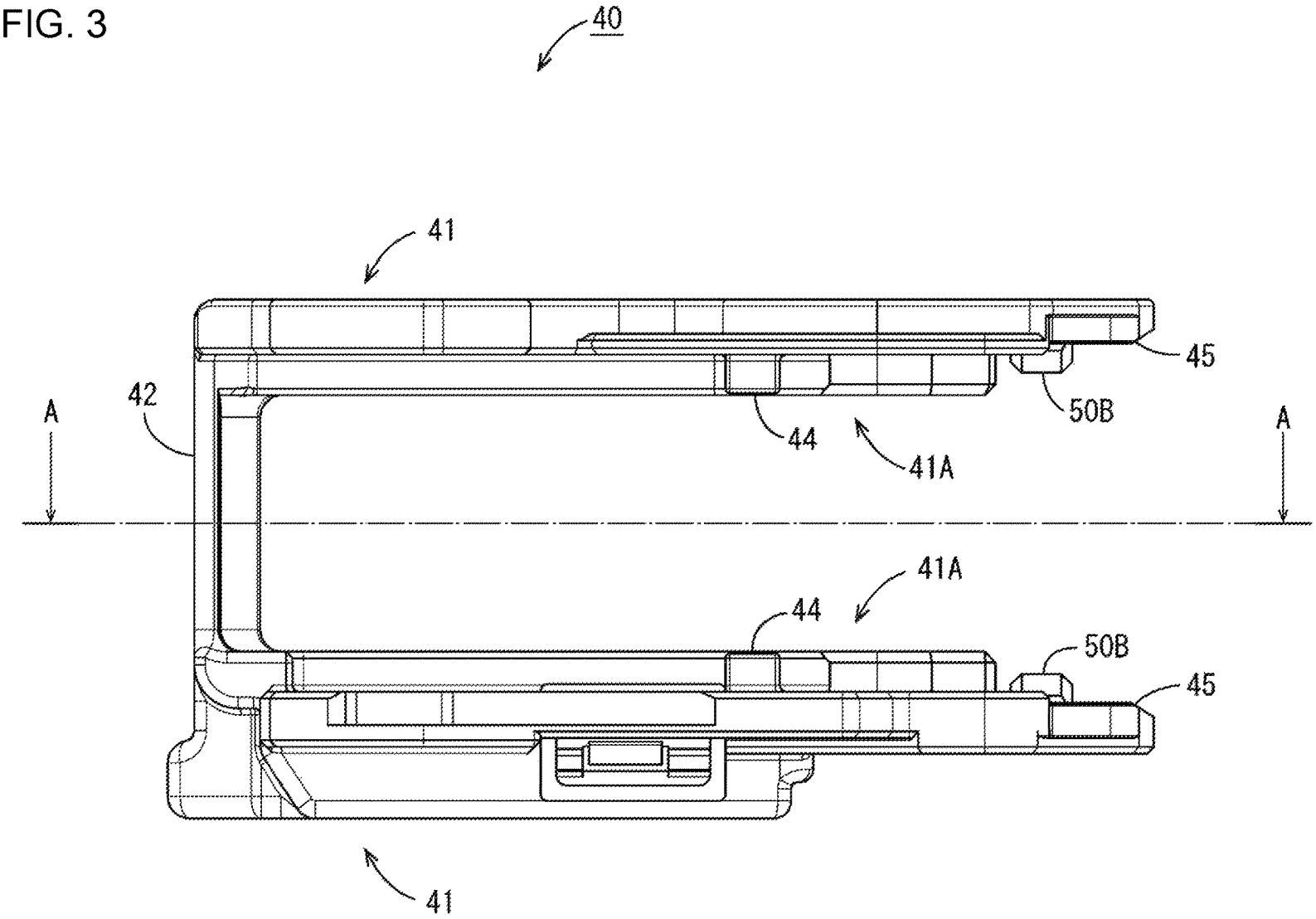
FIG. 3 is a front view of the lever.

As shown in FIGS. 2 and 3, the lever 40 includes two arm plates 41 disposed along the outer side surfaces 12 of the lever mounting portion 20, and an operating portion 42 couples the arm plates 41 to define a U-shape.

Figure 4:
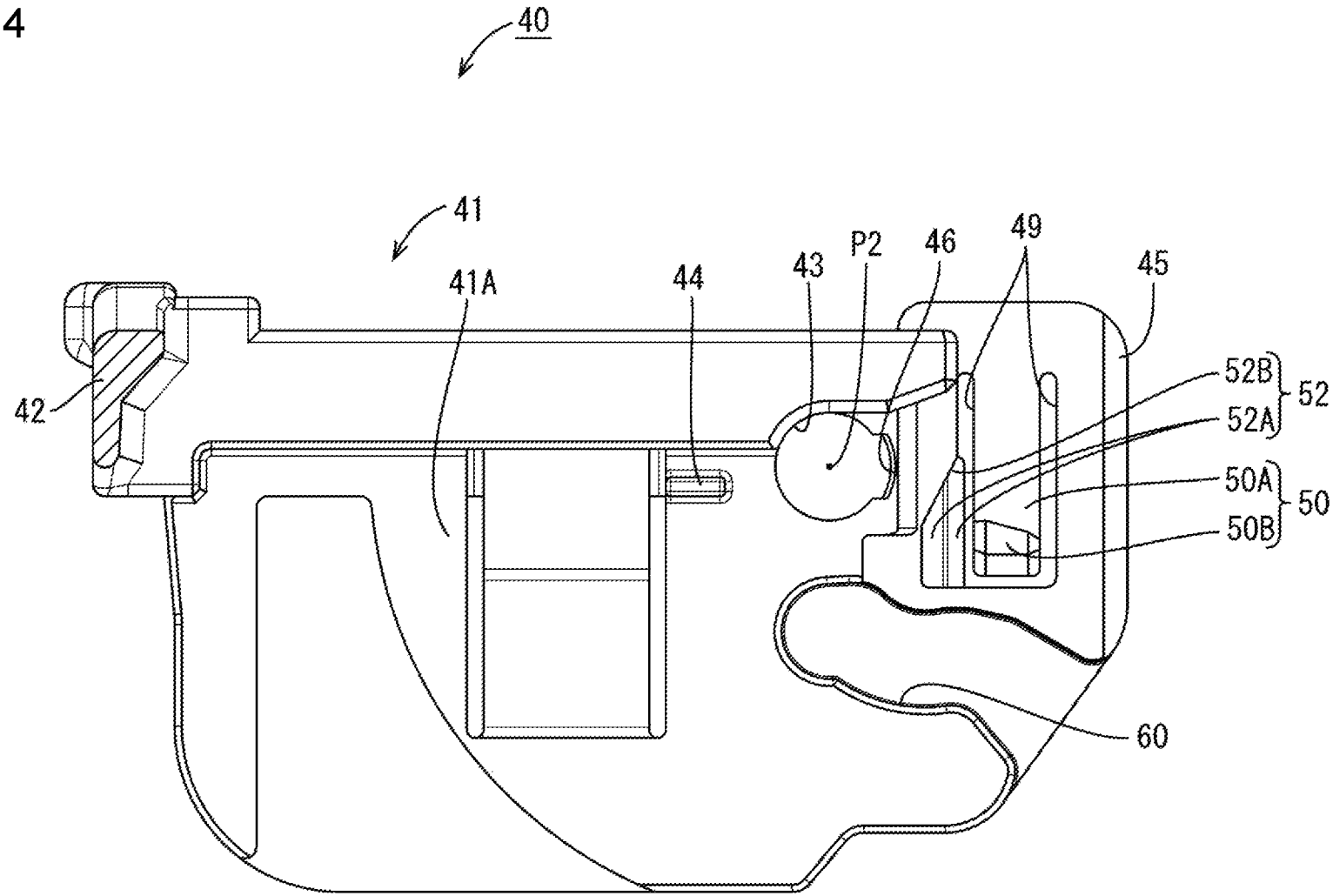
FIG. 4 is a section along A-A of FIG. 3.

As shown in FIG. 4, the opposed facing surface 41A of each arm plate 41 is formed with a shaft hole 43, the ridge piece 44 (an example of a guided portion), an inclined receiving surface 45, a lock 50 and a lock cover 52.

Figure 5:
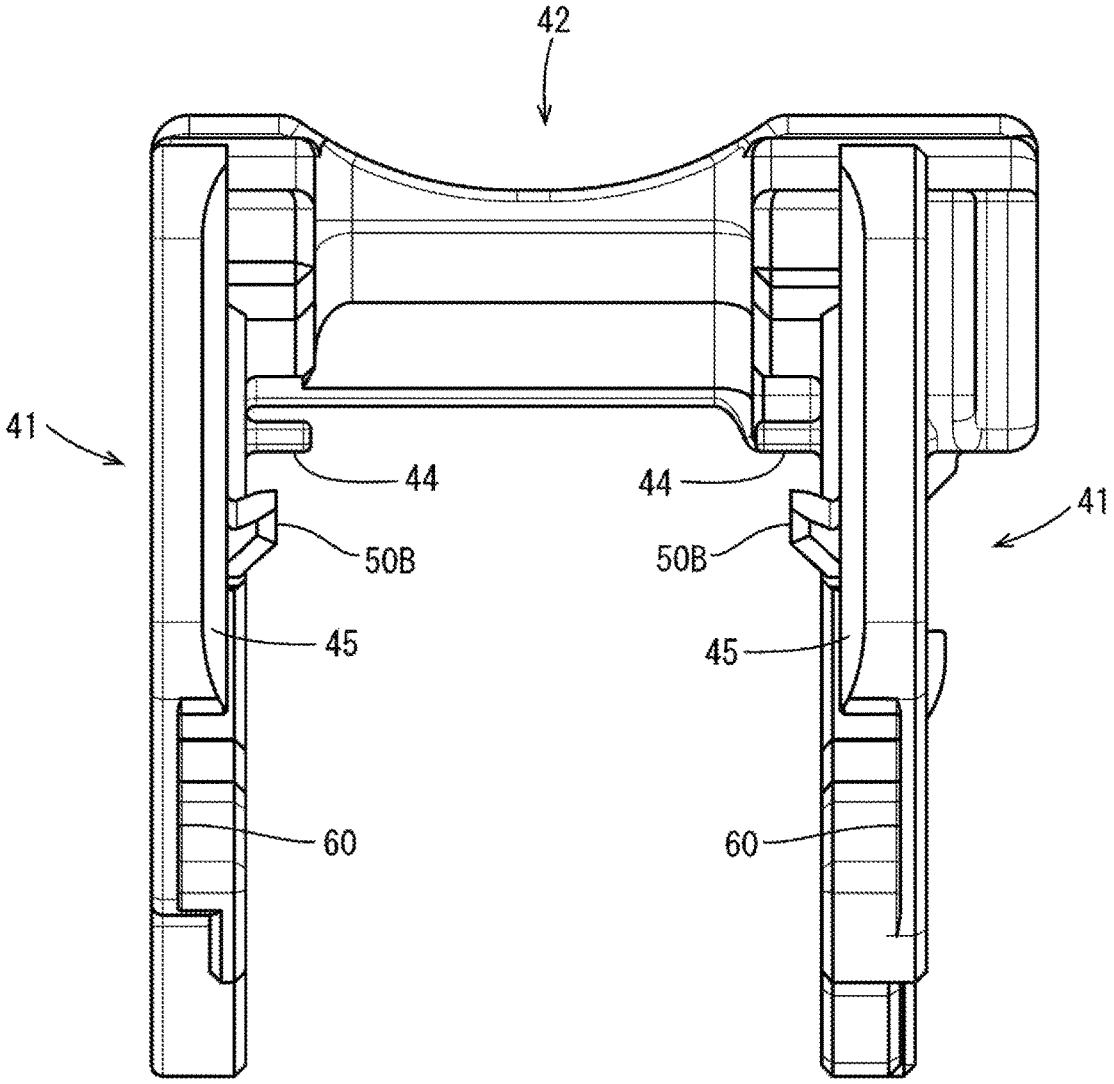
FIG. 5 is a view showing a facing surface of the lever.
Figure 6:
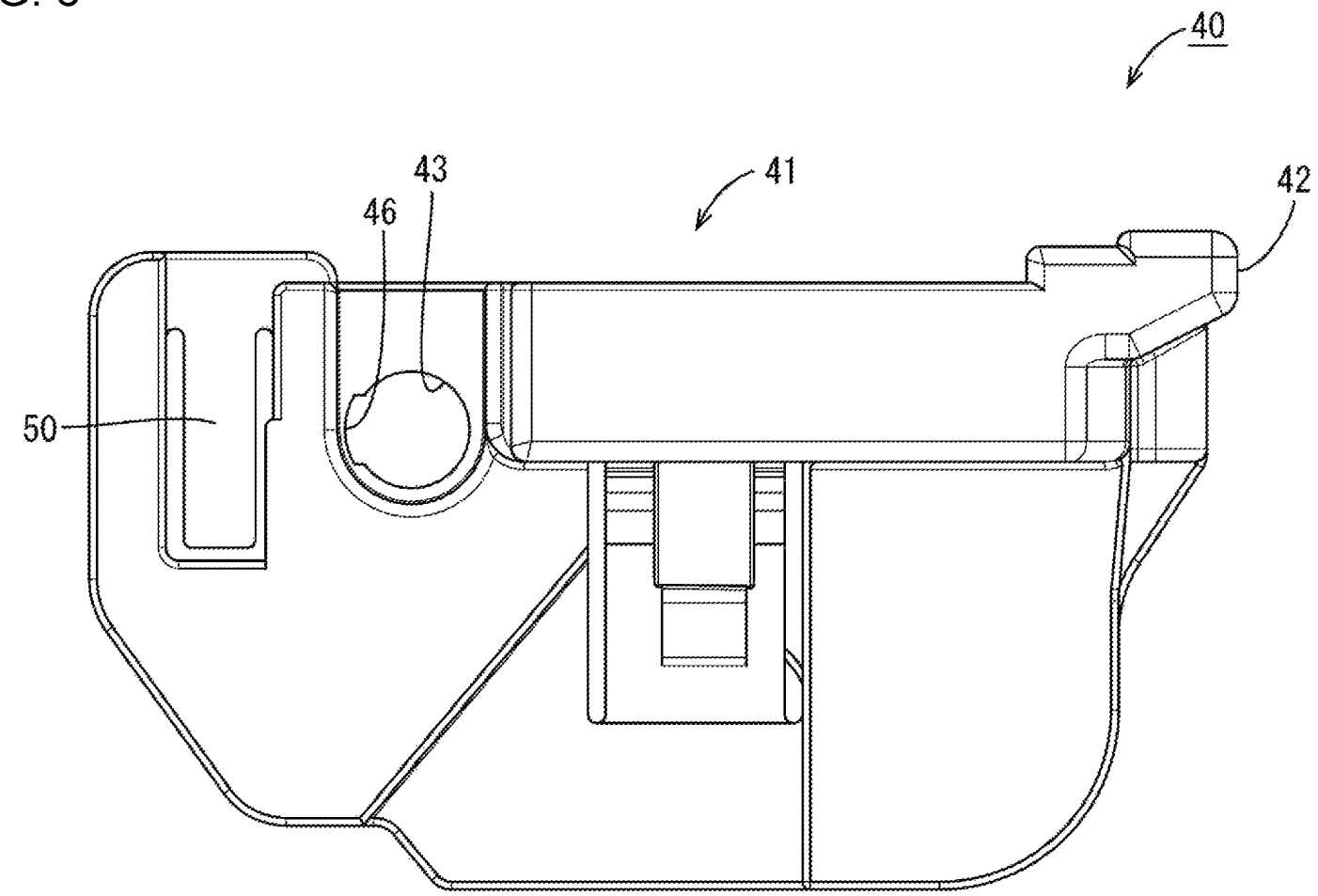
FIG. 6 is a side view of the lever.

As shown in FIGS. 4 and 5, the shaft hole 43 penetrates the arm plate 41 in a plate thickness direction and is circular. A mounting groove 46 is formed on an opening edge of the shaft hole 43 on a side distant from the operating portion 42 and is shaped to correspond to the holding protrusion 25 of the support shaft 21.

The ridge 44 extends laterally between the operating portion 42 and the shaft hole 43.

The inclined receiving surface 45 is formed on a right end of the facing surface 41A in FIG. 4 and is tapered to incline out toward a right edge and toward the operating portion 42.

In FIG. 4, a substantially U-shaped slit 49 is formed to the right of the shaft hole 43. An upper end of the slit 49 in FIG. 4 has a semicircular shape with a diameter equal to a lateral width of the slit 49.

The lock 50 is in the form of a tongue separated from the other part of the arm plate 41 by the slit 49. The lock 50 includes a deflection piece 50A having a base end on an upper side shown in FIG. 15 and the lock claw 50B provided on a free end of the deflection piece 50A. The deflection piece 50A is deflectable and displaceable in a direction perpendicular to the rotating directions R1 of the lever 40. As shown in FIG. 15, the lock claw 50B projects toward the other arm plate 41 in an overhanging manner in the direction perpendicular to the rotating directions R1 of the lever 40.

Figure 16:
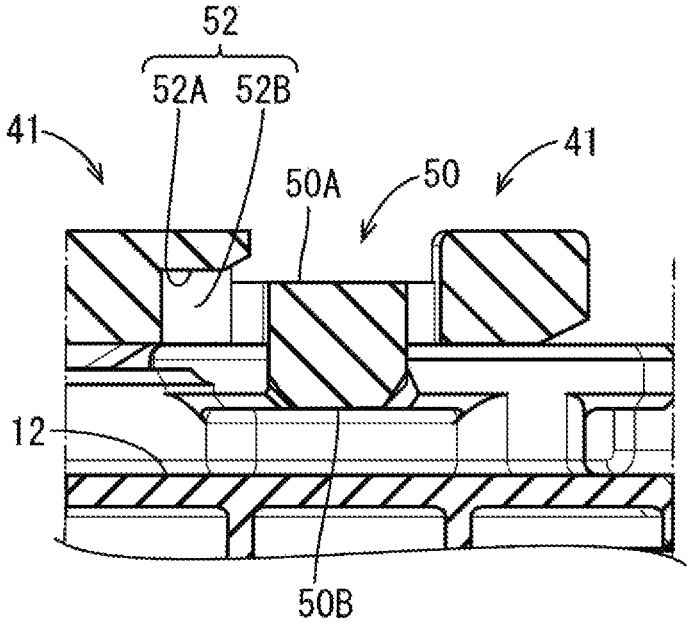
FIG. 16 is a section along D-D of FIG. 13.

Note that the arm plate 41 is formed to project and recede at the slit 49 as a boundary. In this way, the deflection piece 50A is located entirely inward (down in FIG. 16) of the outer surface of the arm plate 41 in a state where the deflection piece 50A is neither deflected nor displaced, as shown in FIG. 16.

The lock cover 52 is provided adjacent to the lock 50. The lock cover 52 is provided with an edge part of the slit 49 closer to the operating portion 42 when viewed from the lock 50 as one end and is formed by recessing the facing surface 41A of the arm plate 41 while leaving an outer surface side. The lock cover 52 includes a ceiling portion 52A facing the outer side surface 12 of the housing 10 and a side wall 52B perpendicular to the ceiling portion 52A and disposed along a direction from a left back of the lock cover 52 of FIG. 4 toward a base end of the lock 50. The ceiling portion 52A is sloped to become gradually thicker from the left edge of the slit 49 toward the left back of the lock cover 52.

The arm plate 41 is formed with a cam groove 60 into which a cam pin of the mating connector is fit. The cam groove 60 is a recess disposed to approach the shaft hole 43 from a right-lower corner of the arm plate 41 and is thinner than other parts.

Figure 7:
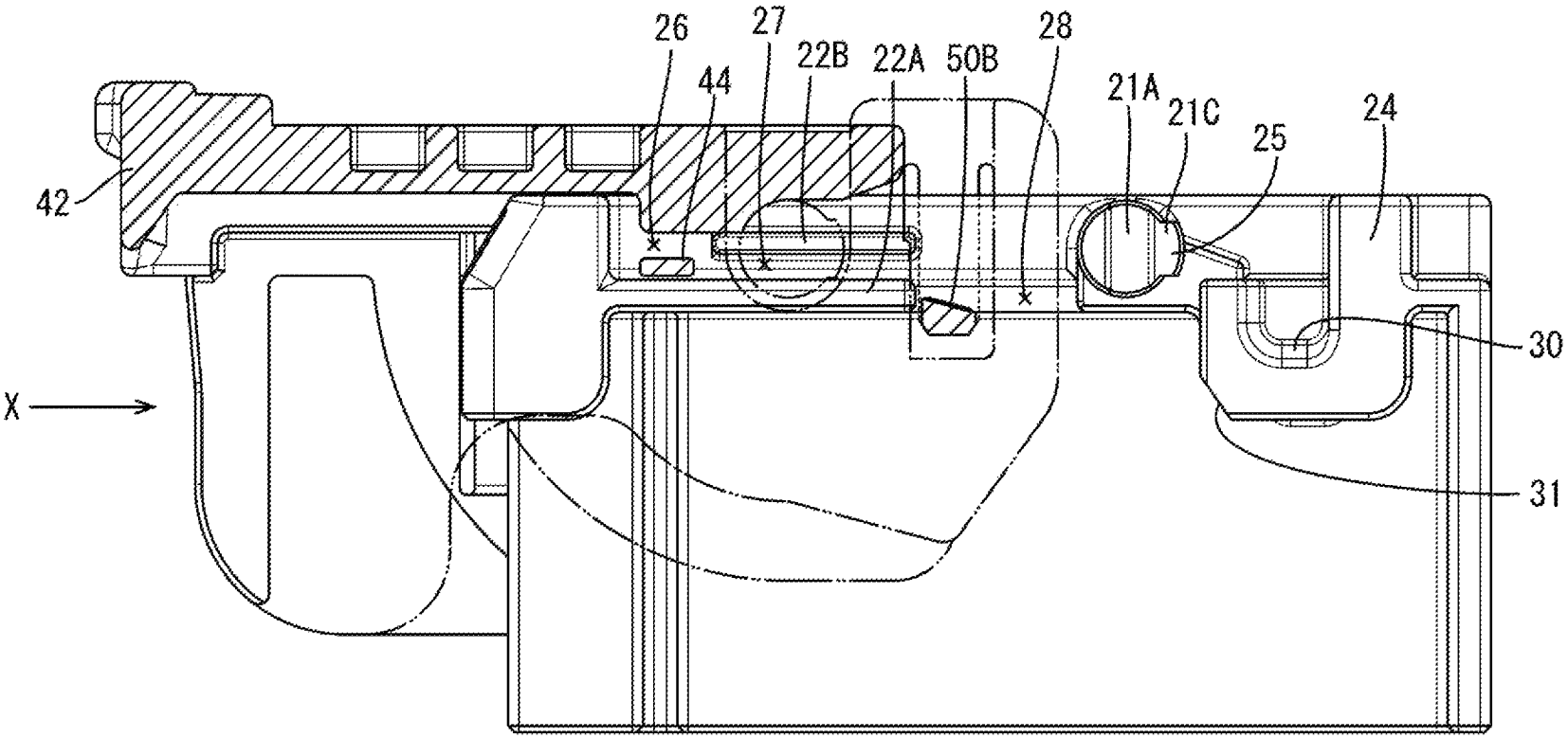
FIG. 7 is a view showing a state where the lever is arranged at an assemble initial position.

To assemble the lever 40 with the housing 10, the lever 40 is arranged behind the housing 10 from a lateral side to position the ridges 44 of the arm plates 41 behind the introducing portions 26 of the housing 10, as shown in FIG. 2, while the wires extending rearward from the housing 10 are disposed between the arm plates 41, 41. The entire lever 40 then is moved forward (direction indicated by an arrow Y in FIG. 2). Then, as shown in FIG. 7, the ridges 44 pass through the introducing portions 26 and butt against the front rails 22A to have any further forward displacement restricted and are arranged to the left of the lateral guiding paths 27. The lock claws 50B of the locks 50 pass through the escaping portions 28 and are arranged at positions adjacent to the right ends of the front rails 22A where leftward displacements are restricted. This position is referred to as an assemble initial position.

Subsequently, the operating portion 42 of the lever 40 is pushed toward the housing 10 (i.e. in a direction indicated by an arrow X in FIG. 7). Then, the ridges 44 are displaced rightward to enter the lateral guiding paths 27 and move rightward in the lateral guiding paths 27 while being guided by the front and rear rails 22A, 22B. Specifically, the lever 40 is guided in a direction perpendicular to an extending direction of the wires with an arrangement direction of the operating portion 42 and the ridge pieces 44 aligned with a direction perpendicular to the extending direction of the wires.

Then, as shown in FIG. 8, the inclined receiving surfaces 45 reach the inclined surfaces 21A of the support shafts 21 and are held in surface contact therewith. This position is referred to as a ride initial position. Specifically, the lever 40 is guided from the assemble initial position to the ride initial position by the guides 22.

Figure 9:
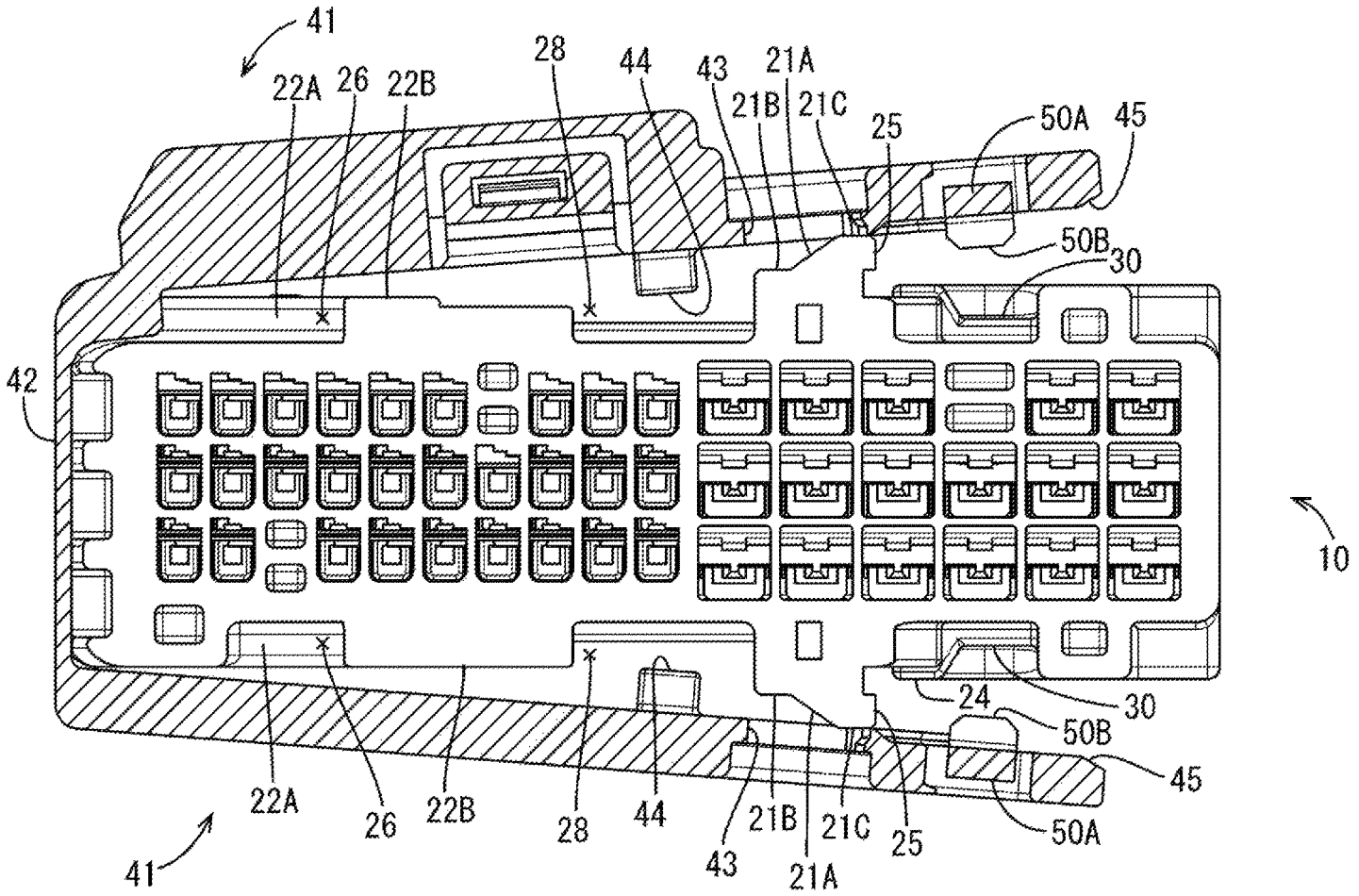
FIG. 9 is a section showing a state where the lever is riding.

The lever 40 then is displaced farther right from the ride initial position by inertia and starts riding on the support shafts 21. Note that if stress in riding on the support shafts 21 is large and the lever 40 cannot ride on the support shafts 21 solely by inertia at this time, the operating portion 42 may be pushed laterally (direction indicated by the arrow Y in FIG. 2). Then, as shown in FIG. 9, the lever 40 rides on the support shafts 21 and gradually resiliently deforms while the facing surfaces 41A of the arm plates 41 are sliding in contact with the support shafts 21 and moving rightward. As a result, the lever 40 is opened in the front-rear direction while the ridges 44 gradually exit from the guiding paths 27. At this time, the locks 50 gradually separate from the outer side surfaces 12 of the housing 10 and move rightward without contacting the planar protrusions 24.

Figure 10:
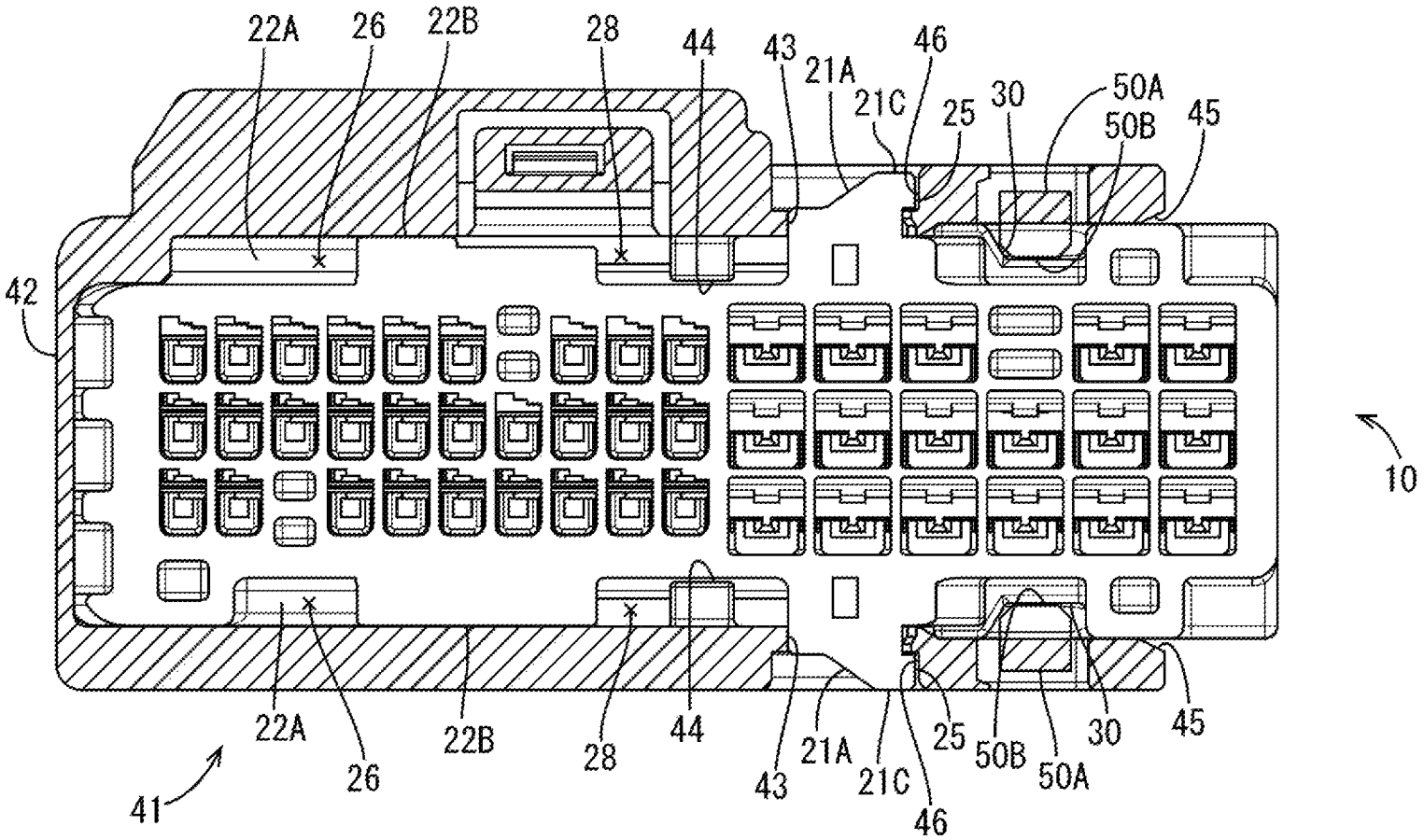
FIG. 10 is a section showing a state where the lever is arranged at an assemble end position.
Figure 11:
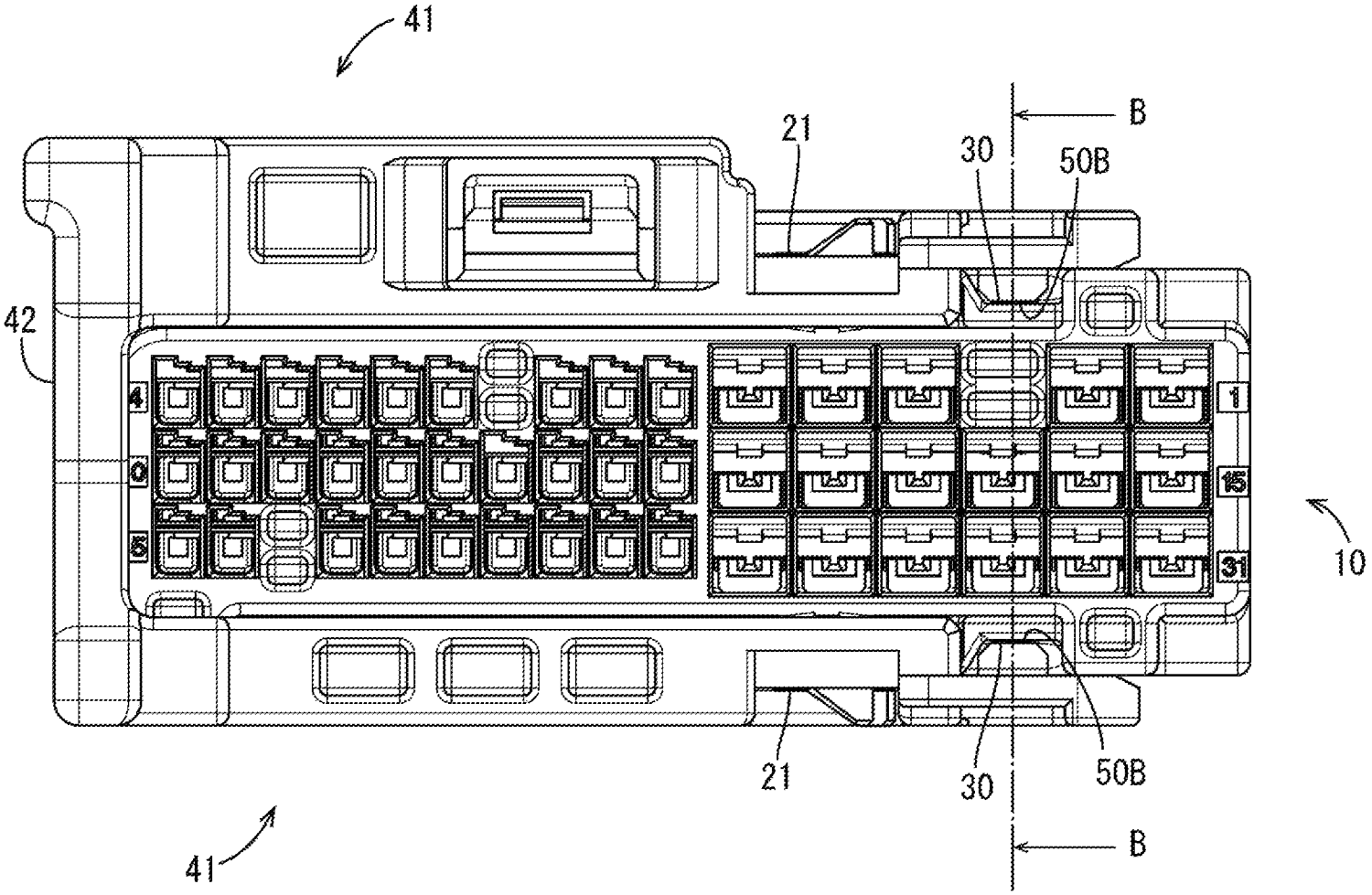
FIG. 11 is a back view of FIG. 10.

The arm plates 41 resiliently return toward each other when the shaft holes 43 reach the support shafts 21, and the shaft holes 43 fit externally on the support shafts 21, as shown in FIGS. 10 and 11. The lock claws 50B of the locks 50 also fit into the locking accommodation recesses 30 of the housing 10 to restrict rightward displacement, as shown in FIGS. 11 and 12. Thus, the assembling of the lever 40 with the housing 10 is completed. This position is referred to as an assemble end position.

Figure 13:
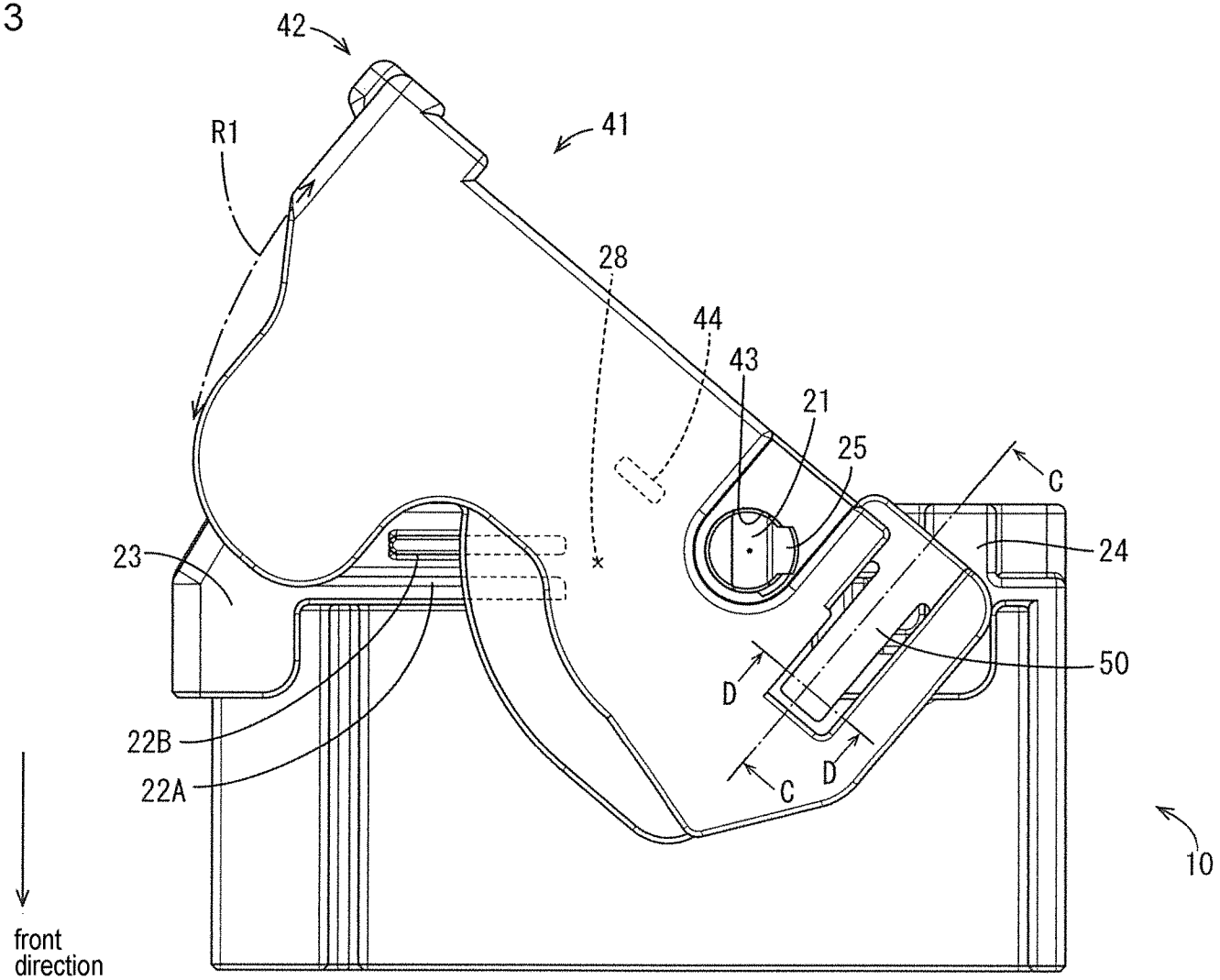
FIG. 13 is a view showing a state where the lever is arranged at a connection initial position.
Figure 14:
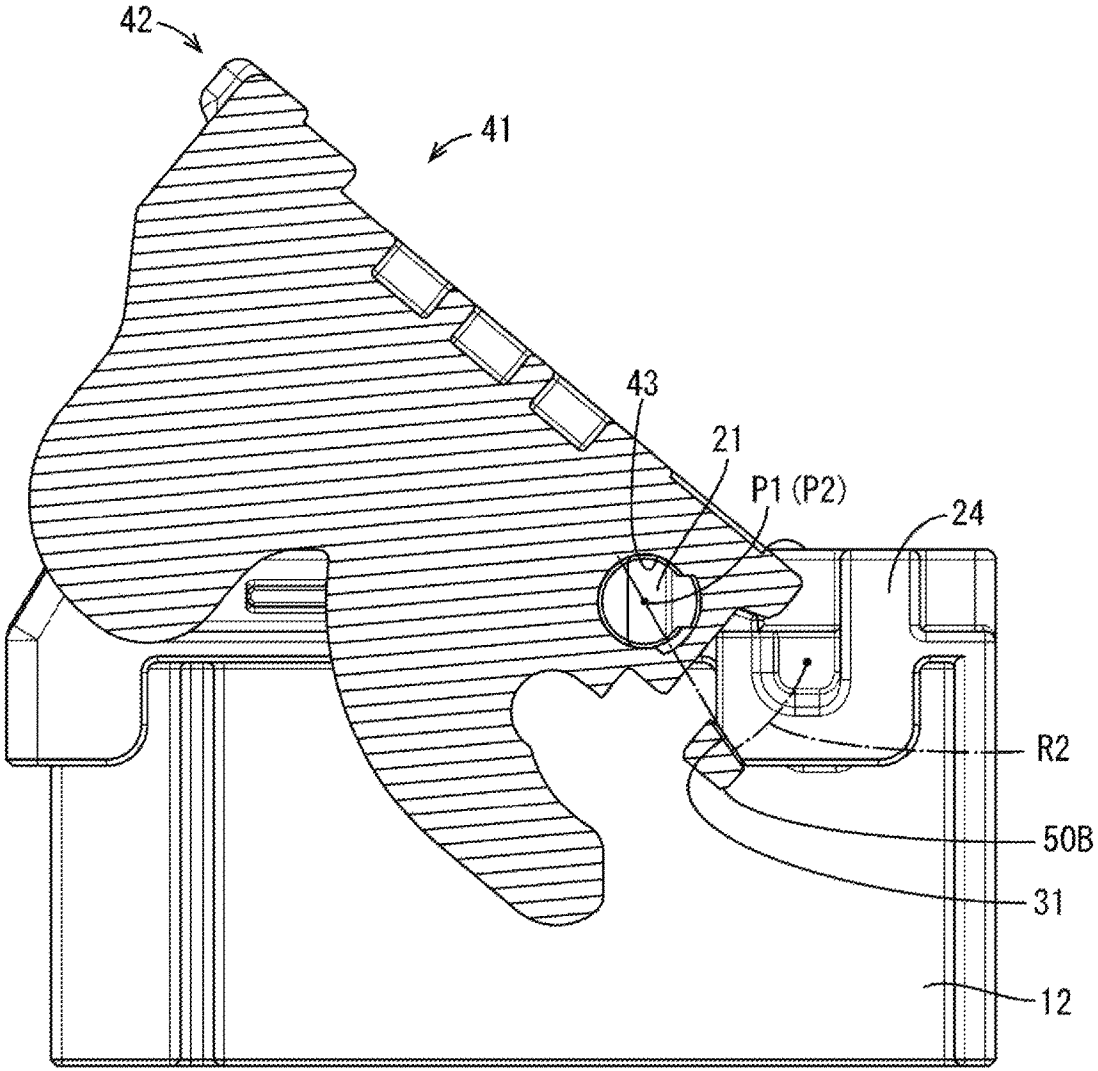
FIG. 14 is a section of FIG. 13.

In connecting the mating connector, the lever 40 is rotated rearward about the support shafts 21 from the assemble end position. Then, as shown in FIG. 13, the holding protrusions 25 of the support shafts 21 lock the shaft holes 43 in an axial direction and the lever 40 is rotated with the opening thereof prevented. Further, according to the rotation, the ridges 44 of the lever 40 exit rearward from the escaping portions 28 and the lock claws 50B of the locks 50 move along the rotation locus R2 shown in FIG. 14 to ride resiliently on the planar protrusions 24. Eventually, the locks 50 move over the planar protrusions 24 to resiliently return and, as shown in FIGS. 14 to 16, return to the state where the locks 50 are inward (toward the housing 10) of the outer surfaces of the arm plates 41 and the lock claws 50B face the lock receiving portions 31. This position is referred to as a connection initial position.

The mating connector is fit into the connector fitting portion 13 from the front with the lever 40 at the connection initial position. Then, the mating connector enters spaces between the outer side surfaces 12 of the housing 10 and the lock claws 50B, thereby pushing the lock claws 50B to positions where the lock claws 50B do not face the lock receiving portions 31. In this way, locking between the lock claws 50B and the lock receiving portions 31 is released to enable rotation of the lever 40.

When the lever 40 is rotated toward the assemble end position, the ridges 44 move toward the escaping portions 28 and the lock claws 50B move along the rotation locus R2 toward the locking accommodation recesses 30 while riding on the planar protrusions 24. Along with this, the cam grooves 60 pull the cam pins of the mating connector toward the support shafts 21. Then, the lever 40 returns to the assemble end position and the lock claws 50B return to the inside of the locking accommodation recesses 30 to complete the connection of the housing 10 and the mating connector.

Figure 17:
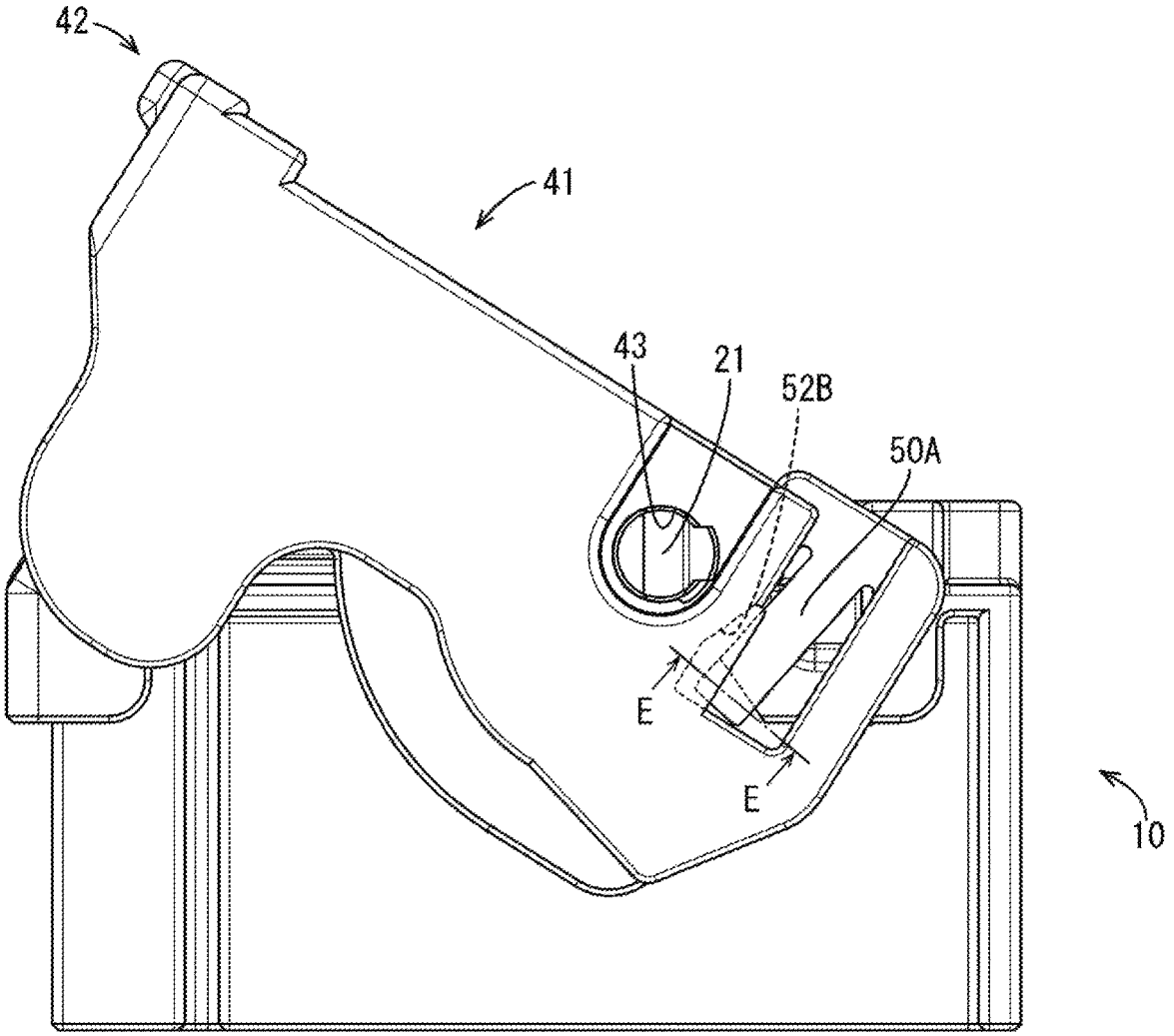
FIG. 17 is a view showing a state where the rotation of the lever is restricted.
Figure 18:
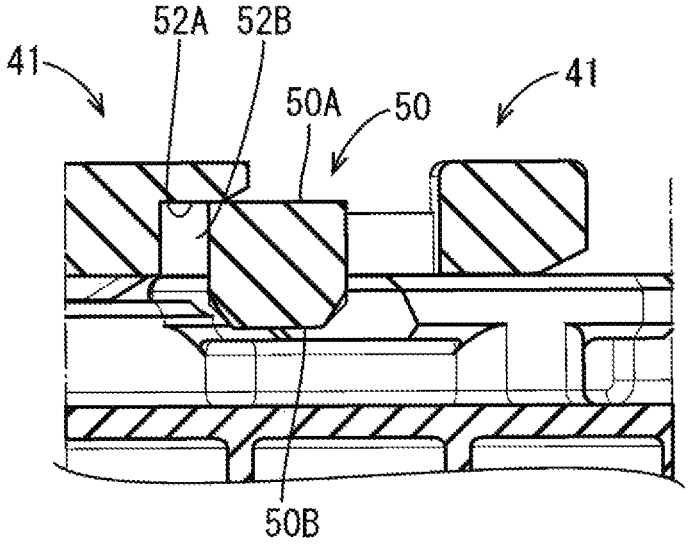
FIG. 18 is a section along E-E of FIG. 17.

Note that if it is attempted to rotate the lever 40 toward the assemble end position without the mating connector being externally fit after the lever 40 is disposed at the connection initial position, the lock claws 50B lock the lock receiving portions 31 disposed to be perpendicular to the rotation locus R2. Thus, the lever 40 enters a rotation restricted state where any further rotation thereof is restricted. If it is attempted to rotate the lever 40 toward the assemble end position despite this, the deflection pieces 50A of the locks 50 are deflected toward the lock covers 52 in the plate surface direction of the arm plates 41 and located relatively inwardly of the arm plates 41, as shown in FIGS. 17 and 18. Specifically, the deflection pieces 50A are covered by the ceiling portions 52A of the lock covers 52. Thus, the locks 50 cannot yield to a force for forcibly rotating the lever 40 and cannot jump in a direction opposite to a direction toward the housing 10. Therefore, locking between the lock claws 50B and the lock receiving portions 31 cannot be released inadvertently.

According to the above configuration, in pushing and mounting the lever 40 onto the housing 10, the arm plates 41 start opening deformation while riding on the support shafts 21 and return when the support shafts 21 align with and fit into the shaft holes 43. Thus, a pushing force for the lever 40 is largest when the opening deformation of the arm plates 41 is started. The inclined receiving surfaces 45 of the arm plates 41 are inclined toward the operating portion 42. Therefore, the arm plates 41 are not tilted when opening and the inclined surfaces 21A ride on the inclined receiving surfaces 45 when the arm plates 41 are opened and deformed with the operating portion 42 as the base. Thus, a riding operation is started with the lever 40 held in a stable posture with respect to the housing 10 and the lever 40 is mounted at once while a proper mounting posture with respect to the housing 10 is maintained.

Further, the inclined surfaces 21A and the inclined receiving surfaces 45 can be brought into surface contact with each other only by linearly displacing the ridges 44 along the guides 22 of the housing 10. Further, when the inclined receiving surfaces 45 ride on the inclined surfaces 21A, the inclined receiving surfaces 45 can directly ride on the support shafts 21 in a guiding direction of the guide portions 22.

The ridges 44 enter between the guide rails 22A, 22B and are guided in a moving direction by the guide rails 22A, 22B. Thus, the lever 40 can be guided reliably from the assemble initial position toward the ride initial position.

The lock claws 50B lock the lock receiving portions 31 and restrict the rotation of the lever 40 from the connection initial position to the assemble end position, and the deflection pieces 50A are inward of the arm plates 41 to have outward displacements restricted. In this way, the locks 50A, 50B cannot jump outward of the arm plates 41 to release locking with the lock receiving portions 31 in an attempt to forcibly rotate the lever 40 in a state where the locks 50 are locking the lock receiving portions 31.

A modification is described with reference to FIG. 19. Note that components corresponding to those of the above embodiment are denoted by reference signs of the embodiment plus 100. The same components, functions and effects as those of the embodiment are not described and the same components as those of the embodiment are denoted by the same reference signs.

Figure 19:
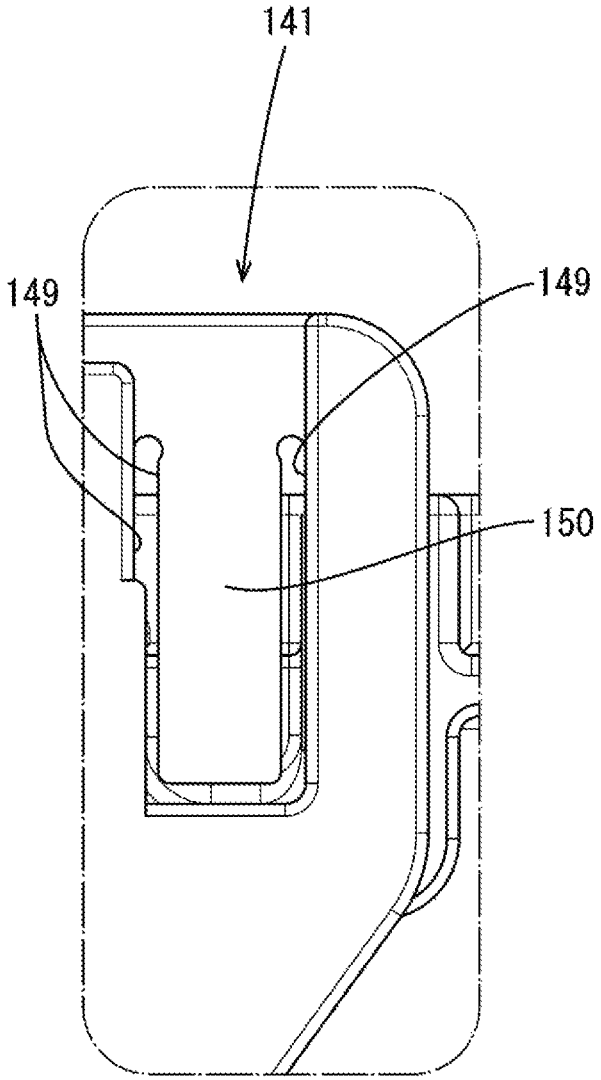
FIG. 19 is a view showing a modification of a lock portion.

The upper end of the slit 49 in the arm plate 41 has a semicircular shape with a diameter equal to the width of the slit 49 in the above embodiment, whereas an upper end of a slit 149 in FIG. 19 is formed into an arcuate shape having a diameter larger than a width of the slit 149 so that a base end of a lock 150 is constricted. In this way, the lock 150 is deflected easily in a plate surface direction of an arm plate 141 and can easily slip under the arm plate 141 when a lever 40 is rotated forcibly from a connection initial position toward an assemble end position without a mating connector being fit externally after being disposed at the connection initial position. Thus, a locked state of the lock 150 and a lock receiving portion 31 can be maintained reliably.

The invention is not limited to the above described and illustrated embodiment and may be embodied as follows.

The inclined receiving surface 45 is provided on the lateral end of the arm plate 41 and the inclined surface 21A is provided in the central part of the projecting end of the support shaft 21 in the lateral direction in the above embodiment. However, the positions of the inclined receiving surface and the inclined surface are not limited to these. For example, the inclined receiving surface may be on the inner surface of the arm plate facing the other arm plate and the entire projecting end of the support shaft may be an inclined surface.

Although the lever 40 reaches the ride initial position while the guided portions (ridges 44) move in the lateral guiding paths 27 by being guided by the guides 22 in the above embodiment, the lever 40 may reach the ride initial position when the guided portions reach ends of the lateral guiding paths or further move in the same direction thereafter by inertia.

The housing 10 has the guide portions 22 and the lever 40 has the guided portions 44 in the above embodiment. However, the guide portions 22 and the guided portions 44 may be omitted. Further, the assemble initial position and the ride initial position may be the same position (i.e. the inclined receiving surfaces of the lever and the inclined surfaces of the support shafts are already in surface contact with each other at the assemble initial position).

Although the operating portion 42, the guided portion 44 and the shaft hole 43 are disposed side by side on the arm plate 41 in the above embodiment, the guided portion 44 may not be disposed side by side with the operating portion 42 and the shaft hole 43. For example, the guided portion 44 may be forward from the operating portion 42 and the shaft hole 43, and the guide 22 of the housing 10 may be at a forward position to correspond to the guided portion 44. In short, it is sufficient that an arrangement direction of the operating portion and the shaft hole is substantially the same as the guiding direction of the guided portion by the guide.

Although the two guide rails 22 are provided as the guide and the ridge 44 is provided as the guided portion in the above embodiment, the shapes of the guide portion and the guided portion are not limited to these. For example, a semi-cylindrical body formed by coupling the projecting ends of the front rail 22A and a part of the rear rail 22B located before the front rail may be provided as the guide and a cylindrical pin or a projecting body having another shape may be provided as the guided portion.

Although the front and rear guide rails 22A, 22B are provided as the guide and one ridge 44 is provided as the guided portion 44 in the above embodiment, the configurations of the guide and the guided portion are not limited to these. For example, front and rear rails may be provided as the guide, and two ridges parallel to each other may be provided as the guided portion. The guide and the guided portion may be configured to guide each other with the both rails of the guide and the both ridges of the guided portion alternately disposed.

Although the lever 40 reaches the ride initial position while the guided portions (ridges 44) are guided by the guides 22 and moving in the lateral guiding paths 27 in the above embodiment, the lever 40 may be configured to reach the ride initial position when the guided portions reach the final ends of the lateral guiding paths or further move in the same direction thereafter by inertia.

LIST OF REFERENCE SIGNS

1: lever-type connector
10: housing
12: outer side surface
21: support shaft
21A: inclined surface
22: guide
22A: front rail
22B: rear rail
41: arm plate
42: operating portion
43: shaft hole
44: ridge
45: inclined receiving surface
40: lever
50: lock

What is claimed is:

1. A lever-type connector, comprising:

a housing with two support shafts projecting on outer side surfaces of the housing, an inclined surface being provided on a projecting end of each of the support shafts; and a lever including two arm plates coupled by an operating portion, each of the arm plates including a shaft hole and a guided portion disposed so that the guided portion, the operating portion and the shaft hole are provided linearly side by side, the lever being mounted on the housing by fitting the support shafts in the shaft holes, the arm plates deforming away from each other while riding on the support shafts as the lever is being mounted on the housing, and the arm plates returning so that the support shafts fit into the shaft holes when the arm plates move over the support shafts to define an assemble initial position of the lever, each of the arm plates further including an inclined receiving surface inclined toward the operating portion, the inclined surface on each of the support shafts being configured to come into surface contact with the inclined receiving surface of each of the arm plates at a ride initial position of the arm plates, the lever-type connector being connectable to a mating connector by rotating the lever about the support shafts, wherein:

a guide is provided on the outer side surface of the housing and is configured to guide the guided portion between the assemble initial position and the ride initial position.

2. The lever-type connector of claim 1, wherein:

the guided portion includes a ridge projecting on an inner side surface of the arm plate;

the guide includes two guide rails projecting from the outer side surface of the housing; and the ridge enters between the guide rails.

3. A lever-type connector comprising:

a housing with two support shafts projecting on outer side surfaces of the housing, an inclined surface being provided on a projecting end of each of the support shafts; and a lever including two arm plates coupled by an operating portion, each of the arm plates including a shaft hole, the lever being mounted on the housing by fitting the support shafts in the shaft holes, the arm plates deforming away from each other while riding on the support shafts as the lever is being mounted on the housing, and the arm plates returning so that the support shafts fit into the shaft holes when the arm plates move over the support shafts to define an assemble end position, each of the arm plates further including an inclined receiving surface inclined toward the operating portion, the inclined surface on each of the support shafts being configured to come into surface contact with the inclined receiving surface of each of the arm plates at a ride initial position of the arm plates, the lever being rotatable about the support shafts from the assemble end position to a connection initial position and being capable of connecting the mating connector to the housing by being rotated from the connection initial position to the assemble end position;

each of the arm plates is provided with a lock including a deflection piece in the form of a tongue deflectable and deformable in a direction perpendicular to a rotating direction of the lever and a lock claw provided on a tip of the deflection piece and projecting in an overhanging manner in a direction perpendicular to a rotating direction of the lever;

a lock receiving portion provided on the outer side surface of the housing and projecting in an overhanging manner on a rotation locus of the lock claw (50B) and lockable by the lock claw; and the deflection piece is located relatively inwardly of the arm plate to restrict deformation in a state where the lock claw is locking the lock receiving portion to restrict rotation between the connection initial position and the assemble end position.

4. A lever-type connector, comprising:

a housing with opposite first and second ends and opposite outer side surfaces extending between the first and second ends, support shafts projecting respectively on the outer side surfaces of the housing, inclined surfaces formed on projecting ends of the support shafts at sides of the support shafts facing toward the first end of the housing, guides formed on the outer side surfaces of the housing at positions between the first end of the housing and the respective support shafts; and a lever including two arm plates coupled by an operating portion, the arm plates having inner surfaces facing one another, ends of the inner surfaces of the arm plates remote from the operating portion being sloped away from one another to define inclined receiving surfaces, a shaft hole being formed in each of the arm plates at a position between the inclined receiving surface and the operating portion, and a guided portion formed on the inner surface of each arm plate at a position to slide along the guides of the housing as the lever is being mounted on the housing and to guide the inclined receiving surface of the arm plates toward the inclined surfaces on the support shafts so that the arm plates deform away from each other while riding on the support shafts as the lever is being mounted on the housing, and the arm plates returning when the shaft holes align with the support shafts so that the support shafts fit into the shaft holes to define an assemble initial position of the lever.

* * * * *